US005376195A

United States Patent [19]

Shindo et al.

[11] Patent Number: 5,376,195

[45] Date of Patent: Dec. 27, 1994

[54] AUSTENITIC STAINLESS STEEL SHEET HAVING EXCELLENT SURFACE QUALITY AND METHOD OF PRODUCING THE SAME

[75] Inventors: Takuji Shindo, Futtsu; Toshiyuki Suehiro, Hikari; Masanori Ueda; Shinichi Teraoka, both of Futtsu; Shuichi Inoue, Hikari, all of Japan

[73] Assignee: Nippon Steel Corporation, Tokyo, Japan

[21] Appl. No.: 167,832

[22] PCT Filed: Apr. 16, 1993

[86] PCT No.: PCT/JP93/00497

§ 371 Date: Dec. 16, 1993

§ 102(e) Date: Dec. 16, 1993

[87] PCT Pub. No.: WO93/21355

PCT Pub. Date: Oct. 28, 1993

[30] Foreign Application Priority Data

Apr. 16, 1992 [JP] Japan ..... 4-96731
Sep. 17, 1992 [JP] Japan ..... 4-248060

[51] Int. Cl.[5] ..... C21D 8/02; C22C 38/40

[52] U.S. Cl. ..... 148/541; 148/544; 148/325; 148/327

[58] Field of Search ..... 148/541, 544, 325, 327

[56] References Cited

U.S. PATENT DOCUMENTS 4,265,679 5/1981 Ohashi et al. ..... 148/12 E
5,030,296 7/1991 Ueda et al. ..... 148/541

FOREIGN PATENT DOCUMENTS 0028984 5/1981 European Pat. Off. .
219426 1/1990 Japan .
372030 3/1991 Japan .
3107427 5/1991 Japan .
342151 2/1992 Japan .
570834 3/1993 Japan ..... 148/541

OTHER PUBLICATIONS

Iron and Steel, 1985, A197–A256.
Camp Isit, 1988, vol. 1, 1674–1705.
International Search Report PCT/JP93/00497, Jul. 20, 1993.
Patent Abstracts of Japan, vol. 7, No. 100, (C-164) (1245), Apr. 28, 1983.
European Search Report EP 93 90 8107.

*Primary Examiner*—Deborah Yee
*Attorney, Agent, or Firm*—Kenyon & Kenyon

[57] ABSTRACT

This invention relates to a austenitic stainless steel thin sheet devoid of work-surface roughening, produced by a continuous casting method of a strip comprising a composition which contains not greater than 0.09% of C+N and has an $Md_{30}$ of 30° to 60° C., and in which colonies A comprising {112}<111>, etc., and colonies B comprising {110}<111>, etc., exist in a uniform mixture in the steel sheet. As to colony dimensions, $d_{RD}(A)$ and $d_{RD}(B)$ are not greater than 300 μm and $d_{TD}(A)$ and $d_{TD}(B)$ are not greater than 200 μm. Solidification cooling is carried out at a cooling rate of at least 100° C./sec, and cooling is carried out to 1,200° C. at a rate of 50° C./sec after solidification. Cold rolling is effected by twice cold rolling with interposed intermediate annealing. In this way, there can be obtained a austenitic strip cast stainless steel sheet not causing work-surface roughening.

5 Claims, 6 Drawing Sheets

AUSTENITIC STAINLESS STEEL SHEET HAVING EXCELLENT SURFACE QUALITY AND METHOD OF PRODUCING THE SAME

TECHNICAL FIELD

This invention relates to an austenitic stainless steel sheet having excellent surface quality which is produced by casting a slab having a thickness approximate to that of a product produced by a so-called "synchronous continuous casting process" in which a mold and a slab move in synchronism with each other, and the slab is directly cold rolled without being passed through hot rolling, and a production method thereof.

BACKGROUND ART

To produce a stainless steel sheet by a continuous casting method, a conventional production method comprises the steps of casting a slab having a thickness of at least 100 mm while oscillating a mold in a casting direction, treating the surface of the obtained slab, heating the slab to a temperature not lower than 1,000° C. in a heating furnace, hot rolling the slab by a hot strip mill comprising a rough rolling mill and a finish rolling mill and obtaining a hot strip having a thickness of several millimeters.

When the hot strip thus obtained is cold rolled, to secure the shape (flatness), mechanical and surface properties required for the final product, hot rolled sheet annealing is carried out to soften a strongly hot worked hot strip and scale, etc., on the surface is removed therefrom by grinding after pickling.

The conventional process described above requires a great deal of energy for heating and working the materials in a long and large hot rolling facility, and also cannot be said to be a really excellent production process from the aspect of producibility. In the final product, there are many limitations for using, because a texture develops in the product, and therefore, when a user conducts press working, etc., of the product sheet, anisotropy must be taken into account.

To solve the problem that a long and large hot rolling facility and a great deal of energy and rolling power are necessary for rolling a slab having a thickness of at least 100 mm to a hot strip, studies have been carried out in recent years in search of the process which obtains a slab (thin strip) having a thickness equal or approximate to a hot strip during the continuous casting process.

For examples, feature articles in "Iron and Steels", '85, A197–A256 and "CAMP ISIJ", Vol. 1, 1988, 1674–1705, disclose a process for directly obtaining the hot strip by continuous casting.

In such a continuous casting process, the use of a twin drum system is examined when the gauge of the obtained slab (strip) is at a level of 1 to 10 mm and a use of a twin belt system is examined when the gauge of that is at a level of 20 to 50 mm.

The continuous casting process of this kind produces a slab having a shape approximate to the final shape, and omits or reduces intermediate steps such as a hot rolling step, a heat-treatment step, and so forth. Accordingly, it is known that a structure of the slab greatly affects the mechanical and surface properties of the final product.

Conventionally, very small corrugations of from about 0.2 to 0.1 μm, which are referred to as "roping", have often occurred on the surface of the steel sheet as cold rolled, in the austenitic stainless steel sheet produced by the strip casting process described above.

Japanese Unexamined Patent Publication (Kokai) No. 2-19426 teaches to first carry out preliminary cold rolling at a reduction ratio of up to 60%, then to carry out intermediate annealing and to thereafter carry out cold rolling to the thickness of the final product, or a so-called "twice cold rolling method", in cold rolling of the cast-strip so as to reduce this "roping". According to this method, plastic working is applied to the strip consisting of coarse $\gamma$ grains so as to first flatten mechanically the surface of the strip and at the same time, strain induced by distortion is built up in the internal structure so as to promote the progress of recrystallization during intermediate annealing. After the crystal grains are made smaller and the strain is sufficiently released, the surface corrugation is reduced by the second cold rolling operation on the basis of the same principle. Accordingly, this method teaches that both in the preliminary rolling process and the second cold rolling process, a greater effect can be obtained by rolling at a higher reduction, and if a preliminary rolling reduction is less than 30%, the effect is small.

The cause for the occurrence of roping described above has not yet been clarified sufficiently, but the inventors of the present invention have assumed the reasons as follows. Namely, the $\gamma$ phase works harden with rolling deformation and at the same time, a rolling texture having a $\{110\}<112>$ orientation as a primary orientation is formed, so that fine corrugations are induced due to plastic anisotropy of the cold rolled band structure (which resists deformation in the direction of thickness of the sheet) comprising this hardened orientation. For this reason, when a large number of martensite phases ($\alpha'$ phase) induced by working are generated by increasing the cold rolling reduction, the effect of cutting off the gamma phase occurs and the amount of roping is expected to fall. It is appreciated that Japanese Unexamined Patent Publication (Kokai) No. 2-19426 aims at eventually utilizing this effect.

Japanese Unexamined Patent Publication (Kokai) No. 3-42151 attempts to reduce roping by increasing the amount of a martensite phase generated during cold rolling by setting an $Md_{30}$ point calculated from a composition in the range of 30° to 60° C.

The present inventors have examined in detail press workability of the sheet produced by an austenitic stainless steel sheet production process based on strip casting, and have found out that surface defects referred to as "work-surface roughening", which is obviously different from roping occurring during cold rolling and which exhibits a ridge height of at least about 2 μm as described below, in the case that a work manufacturer, etc., carries out press working the product sheet after final annealing in order to produce a final work product. Roping is believed to occur on the basis of the cold rolled structure in which the $\gamma$ phase and the $\alpha'$ phase exist in mixture, but work-surface roughening is expected to occur on the basis of the gamma phase subjected to the recrystallization annealing treatment and to comprise entirely different orientations from the cold rolled state from the aspect of the texture, as well. In other works, this work-surface roughening cannot at all be prevented by the roping solution methods described in the prior art references described above.

In other words, work-surface roughening remarkably occurs when stretch forming is carried out under a biaxial stress state to an austenitic steel sheet produced by the strip casting method, and is a ridge-like surface defect in which corrugations exist on the steel sheet surface in a direction parallel to the rolling direction and ridges having a predetermined angle to the rolling direction exist on the steel sheet surface. When the degree of press working is high, the maximum ridge height of this defect is as large as 2 to 6 μm, and this is the critical defect which cannot be observed in the sheet produced by a conventional continuous casting/hot rolling/cold rolling process (hereinafter referred to as the "contentional method").

Work-surface roughening remarkably deteriorates the value of the strip-cast sheet products for working applications, and technology for preventing this defect has been necessary.

DISCLOSURE OF THE INVENTION

The present invention aims at providing an austenitic strip-cast stainless steel sheet having excellent surface quality without the occurrence of work-surface roughening, and a method of producing the same.

To accomplish the object described above, the present inventors provide the following austenitic stainless steel thin sheet.

Namely, the austenitic stainless steel sheet according to the present invention has the composition wherein C+N is not greater than 0.090 mass %, and $Md_{30}$ defined by $Md_{30}=413-462(C+N)-9.2Si-8.1Mn-13.7Cr-18.5Mo-9.5(Ni+Cu)$ (each component being expressed by mass %) is from 30° to 60° C., moreover, on a plane of an arbitrary sheet thickness layer portion parallel to the surface of the steel sheet, both colonies A, having a mean dimension $d_{RD}(A)$ in a rolling direction and a mean dimension $d_{TD}(A)$ in a direction of width of a sheet and having a primary crystal orientation of {112}<111>, {113}<332>, and colonies B, having a mean dimension $d_{RD}(B)$ in the rolling direction and a mean dimension $d_{TD}(B)$ in the direction of width of the sheet and a primary crystal orientation of {110}<111>, {110}<112>, {110}<001>, exist in the steel sheet in a uniform mixture, and $d_{RD}(A)$ or $d_{RD}(B)$ is not greater than 300 μm, and $d_{TD}(A)$ or $d_{TD}(B)$ is not greater than 200 μm.

The term "uniform mixture state" described above means the state where the maximum value of the length of a line connecting the area centroid of an arbitrary colony to the area centroid of the most adjacent colony of the same or different kind is not greater than 350 μm.

The sheet described above is produced by the following method.

First, a molten steel having a composition wherein C+N is not greater than 0.09 mass % and $Md_{30}$ defined by $Md_{30}=413-462(C+N)-9.2Si-8.1Mn-13.7Cr-18.5Mo-9.5(Ni+Cu)$ (each component being expressed in terms of mass %) is from 30° to 60° C. is cast into a thin strip like slab having a thickness of not greater than 10 mm at a solidification cooling rate of at least 100° C./sec by a continuous casting machine having the mold wall of which moves in synchronism with the slab, is cooled, after solidification, from the highest possible temperature to 1,200° C. at a cooling rate of at least 50° C./sec, is coiled at about 900° C., is then subjected to cold rolling with a reduction of at least 10%, is next subjected to an intermediate annealing at a temperature of from 1,000° to 1,200° C., is thereafter cold rolled to a final sheet thickness, and is finally annealed.

Here, the term "$Md_{30}$" represents a temperature at which at least 50% of a structure changes to a martensite when cold working is carried out at a reduction of 30% thereto, as generally used in this field of art.

In other words, to reduce work-surface roughening described above, the present inventors have clarified that mere reduction of the grain size of the metal structure where is used for a roping-control measures in the conventional process is not sufficient, and the existence of the uniform mixture of the colonies having dimensions below a certain critical value and mutually different orientations is necessary together with the reduction of the grain size. To accomplish this object, the present inventors have also clarified that the molten steel component of which the $Md_{30}$ value is stipulated to be not lower than 30° C. and the quenched and solidified strip-slab must be combined with twice rolling operations interposing intermediate annealing between them.

In other words, when a composition is selected in such a manner that $Md_{30}$ exceeds 30° C., the generation quantity of the $\alpha'$ phase (strain-induced martensite phase) increases during cold rolling, so that the breaking effect of the gamma phase can be improved and at the same time, the hard $\alpha'$ phase increases the storage of the cold rolling strain near the gamma phase. Accordingly, the recrystallized structure of intermediate annealing is made still smaller. Though the detailed mechanism which takes the crystal orientation into account is described elsewhere, when $Md_{30}$ is increased and the twice rolling method which effects intermediate annealing after preliminary cold rolling is carried out, the crystal orientations of the recrystallized structure of intermediate annealing, that is, the crystal grain aggregates of the {112}<111>γ orientation and the {110}<111>γ orientation, uniformly mix with one another, so that the formation of the colonies becomes slightly. When cold rolling is carried out twice in this way, the grain size reduction of the intermediate annealed structure and the crystal orientation improvement effect operate effectively and in consequence, work-surface roughening of the product after final annealing can be markedly reduced.

BEST MODE FOR CARRYING OUT THE INVENTION

Hereinafter, the best mode for carrying out the present invention will be explained.

First of all, the present inventors have examined the relationship between a mean $\gamma$ grain size of a austenitic stainless steel strip-cast slab corresponding to a SUS304 steel and work-surface roughening height of the product material. In other words, continuous cast slabs having a thickness of 2.5 mm were produced from steels having several compositions having mutually different $Md_{30}$ points as tabulated in Table 1, and by changing the mean gamma grain size for each of the slabs. Each of the resulting slabs was cold rolled at a reduction of 40%, and the obtained cold rolled sheet having a thickness of 1.5 mm was intermediate annealed wherein it was retained at 1,150° C. for 20 minutes. Further, the sheet was rolled at a reduction of 60% to obtain a sheet having thickness of 0.6 mm. After bright annealing (at 1,190° C. for 20 seconds) and refining rolling were carried out, cylinder flat-bottom bulge working (punch diameter: 50 mm, bulging height: 10 mm) was carried out so as to measure work-surface roughening height.

Figure 1:
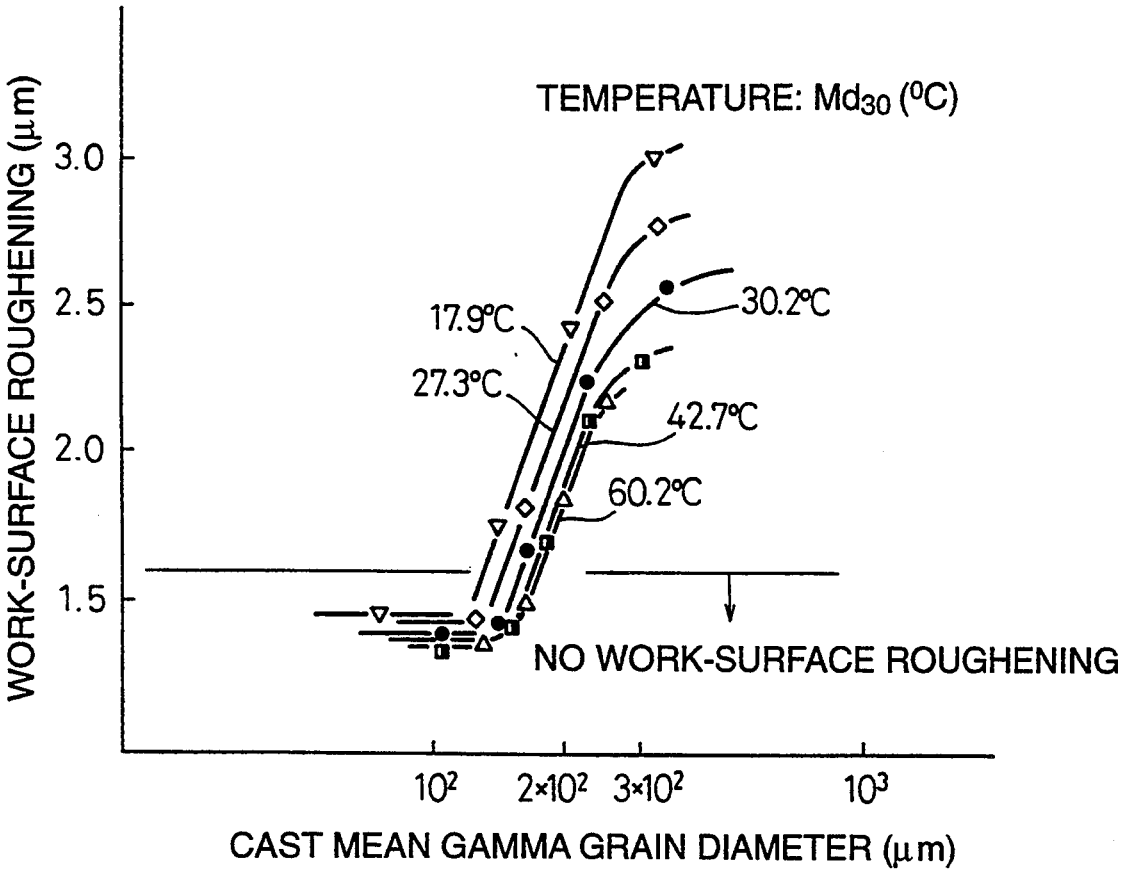
FIG. 1 is a diagram showing the relationship between a mean γ grain size of a slab and work-surface roughening height for materials having several $Md_{30}$ values.

FIG. 1 illustrates the results of measurement. In other words, the present inventors have first realized the following points:

(1) In the case of the same composition material in which the $Md_{30}$ point exhibits a constant value, the work-surface roughening height of the product increases with an increase in the mean gamma grain size of the slab.

(2) When the $Md_{30}$ point is high, the work-surface roughening height drops.

Figure 2:
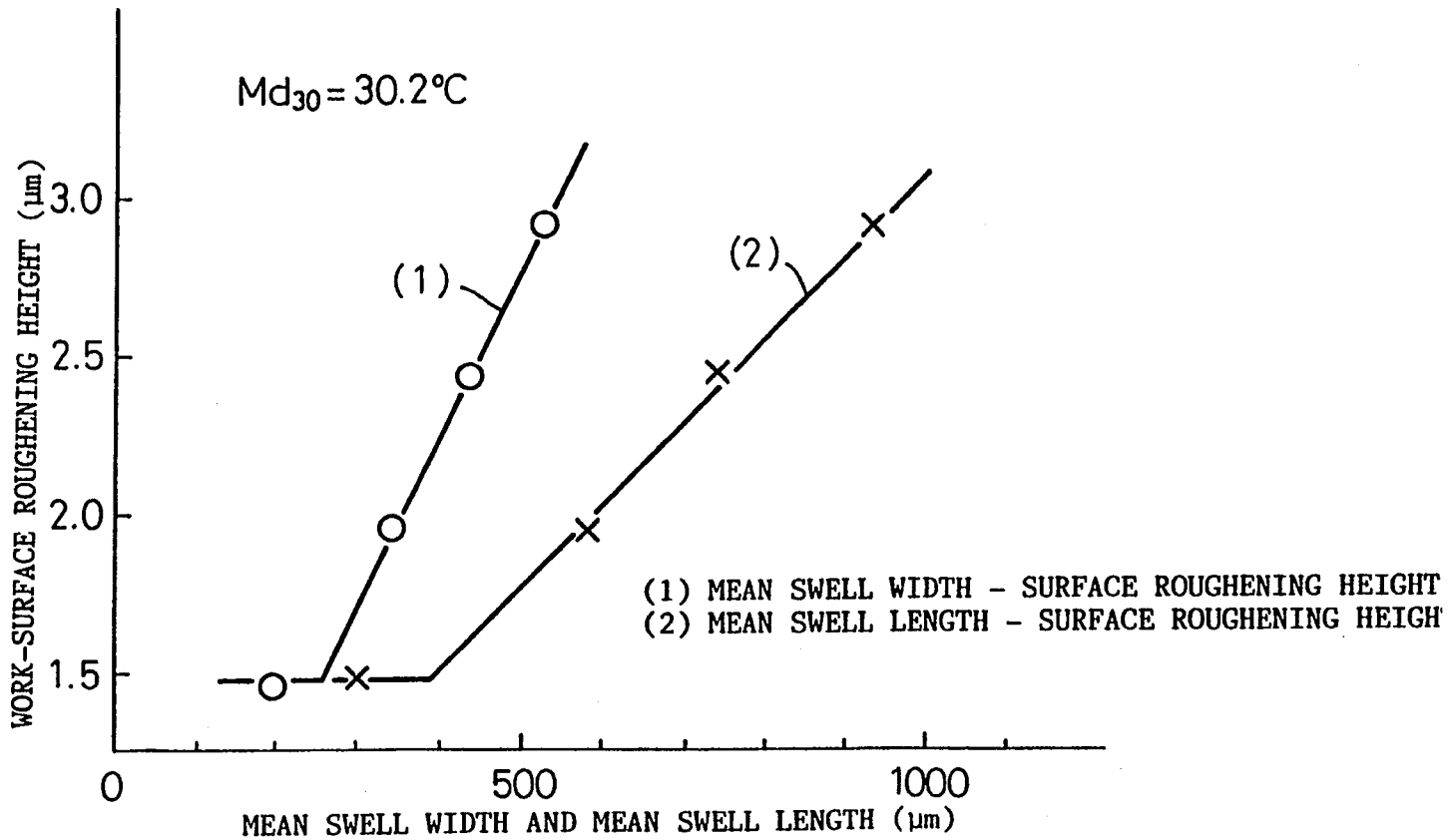
FIG. 2 is a diagram showing the relationship between a mean swell width and a mean swell length of work-surface roughening and a work-surface roughening height.

FIG. 2 shows the result of the investigation of the relationship between the work-surface roughening height and a mean swell width and a mean swell length in materials having the $Md_{30}$ point of 30.2° C. The present inventors have clarified that when the swell width is greater than about 200 μm (solidified mean gamma grain size: 100 μm), the surface roughening height linearly increases in proportion to the swell width, and that when the swell length is greater than 300 μm, the surface roughening height linearly increases. It has thus been confirmed from such results that the work-surface roughening height must be kept below at most 1.6 μm in order to prevent work-surface roughening.

As can be appreciated from an example of a ridging phenomenon in alpha-system stainless steels, the ridge-like surface defects of this kind resulting from working mostly occurs when the textures remarkably develop in the steel sheet and several kinds of "aggregates of crystal grains having specific crystal orientations" (hereinafter referred to as the "colonies") are formed, as a result, plastic anisotropy is formed.

TABLE 1

| Sample | Chemical composition (mass %) | | | | | | | | | | | | | $Md_{30}$ |
|---|---|---|---|---|---|---|---|---|---|---|---|---|---|---|
| | C | Si | Mn | P | S | Cu | Ni | Cr | Mo | Al | N | O | C + N | (°C.) |
| 1 | 0.040 | 0.53 | 1.01 | 0.014 | 0.002 | 0.1 | 9.52 | 18.50 | 0.15 | 0.003 | 0.032 | 0.010 | 0.072 | 17.9 |
| 2 | 0.030 | 0.57 | 0.99 | 0.014 | 0.003 | 0.2 | 8.99 | 18.50 | 0.21 | 0.002 | 0.030 | 0.011 | 0.060 | 27.3 |
| 3 | 0.026 | 0.60 | 0.84 | 0.018 | 0.002 | 0.1 | 9.43 | 18.40 | 0.23 | 0.002 | 0.025 | 0.013 | 0.051 | 30.2 |
| 4 | 0.025 | 0.70 | 0.95 | 0.020 | 0.003 | 0.1 | 8.92 | 18.07 | 0.10 | 0.003 | 0.020 | 0.010 | 0.045 | 42.7 |
| 5 | 0.010 | 0.51 | 0.82 | 0.021 | 0.003 | 0.1 | 8.66 | 18.00 | 0.13 | 0.003 | 0.010 | 0.013 | 0.020 | 60.2 |

The present inventors have examined details of textures, metal structures and component segregations, etc., of materials produced by austenitic stainless steel strip casting processes, that is, a cast strip, a cold rolled material, an annealed material, a product material (as-temper-rolled), and those of biaxial stretch forming materials, and have clarified the cause for the occurrence of work-surface roughening as described below.

The explanation will be given on the case of a continuous casting slab of the austenitic stainless steel which has an $Md_{30}$ point of 27.3° C., and which exhibits a work-surface roughening height of the product of 2.8 μm, and which has a large mean gamma grain size (about 130 μm), by way of example.

Figures 3A, 3B:
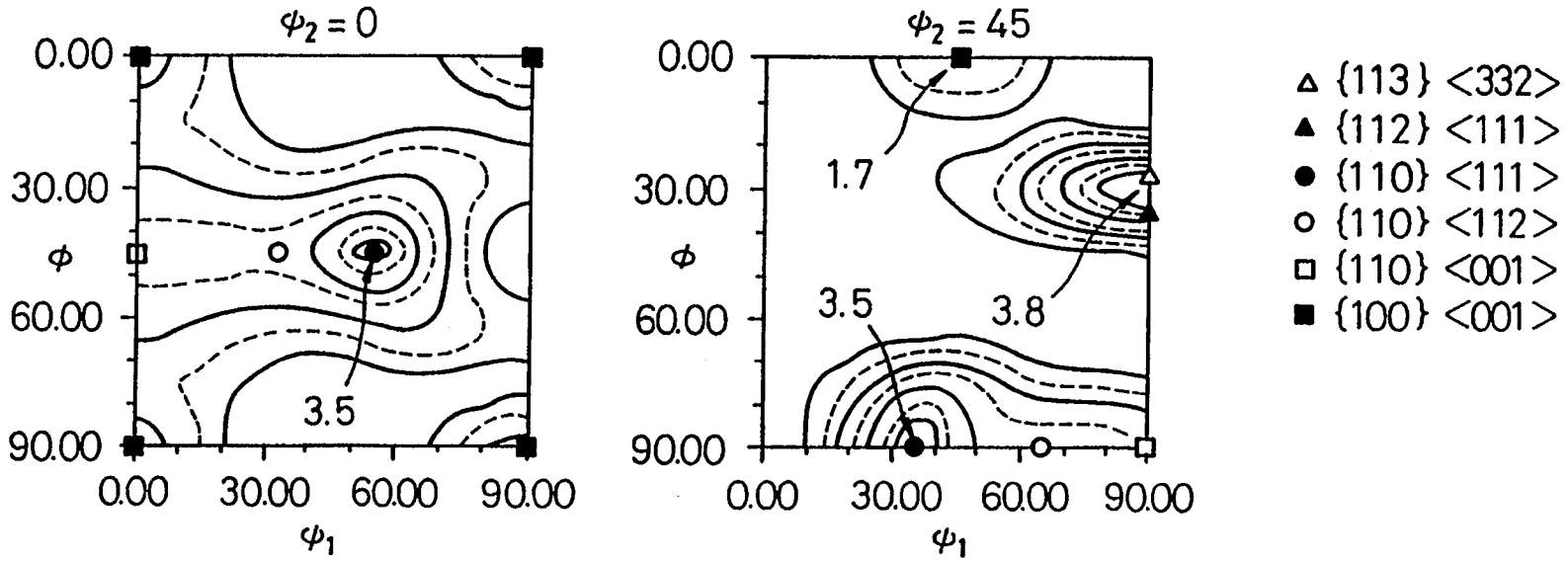
FIGS. 3(A) and 3(B) are diagrams each showing an analytical result of a crystallite orientation distribution function (ODF) of a ¼ thickness layer portion of a product in which work-surface roughening is remarkably observed.

FIGS. 3(A) and 3(B) shows the result of analysis of the crystallite orientation distribution (ODF: Orientation Distribution Function) of a ¼ thickness layer portion of the product of this material. This ODF is generally calculated by a series expansion method proposed by H. J. Bunge et al. on the basis of at least three kinds of pole figure data such as (100), (110) and (113) pole figures, and the crystal orientation of the individual crystals in the material is represented by three Euler angles ($\Psi_1$, $\phi$, $\Psi_2$). The ideal orientation {HKL}<UVW> as the primary orientation of the texture such as {112}<111> corresponds to specific positions in a three-dimensional angular space having $\Psi_1$, $\phi$, $\Psi_2$ as the primary orthogonal axes from the geometrical relationship between the crystalline and the sheet material, and a typical primary orientation in rolling/recrystallization exists in $\Psi_2=0°$ and $\Psi_2=45°$ sections, for example. When the crystal orientation distribution is completely random, the orientation density is defined as 1.0. As can be understood from the $\Psi_2=0°$ section (FIG. 3(A)) and the $\Psi_2=45°$ section, (A) {112}<111> having an orientation density of 3.8 and (B) {110}<111> having an orientation density of 3.5 are the primary orientations, and substantially equal quantities of them exist (Strictly speaking, the (A) orientation contains substantially the same quantity of {113}<332> as {112}<111>). When the product sheet of the conventional process having work-surface roughening within an allowable range (up to 1.6 μm) is subjected to the ODF analysis, it has been found out that the orientation density of (A) {112}<111> is 5.5 and that of (B) {110}<111> is 2.2. In other words, it has been found out that when work-surface roughening occurs, the orientation density of (B) {110}<111> relatively increases.

Next, the present inventors have measured a (110) pole figure of dozens of adjacent local areas of 0.5 mm×1.0 mm corresponding to the pitch of ridge-like corrugations of the product having remarkable work-surface roughening, through a transmission method, by high luminance monochromatic beam (Syncrotron radiation beam) micro-focused beam X-ray process. As a result, the present inventors have clarified that colonies primarily comprising the (A) {112}<111> orientation grains and colonies primarily comprising (B) {110}<111>, {110}<112>, {110}<001> orientation grains obviously exist respectively in segregation at adjacent different places.

Though metallographic examination of the (A) and (B) orientation colonies has been carried out in this instance, no structural difference has been found out between them. Similar measurement has been carried out for the product sheets produced by the prior art method, but segregation of the specific orientation colonies has not been discovered and the (A) and (B) orientation colonies have been found to be uniformly dispersed. Furthermore, though metallographic examination of the sample surface, on which the (A) and (B) orientation colonies are observed, is carried out in this instance, no structural difference has been found between the (A) and (B) orientation colonies. Next, compositional segregation of Ni, Cr, etc., in these regions are examined by an EPMA apparatus capable of two-dimensional elementary mapping, but no significant difference has been found. From these results, it can be understood that work-surface roughening is a phenomenon resulting from the crystal orientations.

Assuming that the {112} orientation and the {110} orientation of the austenitic stainless steel belonging to the face-centered cubic system are uniaxially compressed (which can be assumed to be equivalent to equibiaxial stretch forming) in parallel with the normal direction of the crystal plane, it is expected from the theory of crystal plasticity that the {112} orientation grains exhibit a yield strength of about 84% of the {110} orientation grains. When the (A) {112}<111>, {113}<332> orientation grains and the (B) {110}<111>, {110}<112>, {110}<001> orientation grains form colonies in the material and exist non-uniformly with a coarse region dimensional pitch, surface roughening ridge-like corrugations are believed to occur during working due to their plastic anisotropy.

Figure 4:
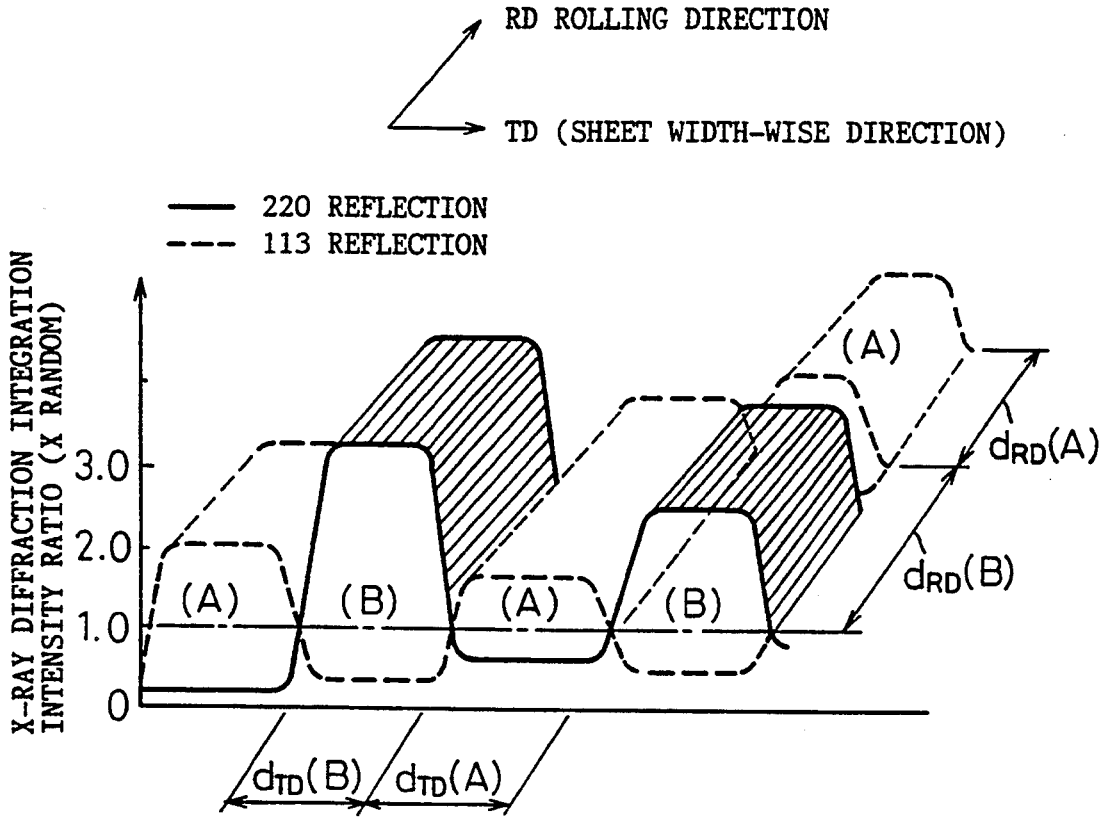
FIG. 4 is a diagram schematically showing a distribution state of colonies A and B.

To clarify the detailed distribution condition of the colonies on the sheet surface of the product from this aspect, the present inventors have analyzed the distribution conditions of the {113}−{112} orientation colonies and the {110} orientation colonies of the 10 mm×10 mm dimensional regions and their mean sizes by the use of a crystal orientation topograph X-ray analyzer (an apparatus which irradiates X-rays having a beam diameter of 50 μm onto a sample held on a rotary sample table equipped with a two-dimensional movement function, and maps an orientation distribution for each position by simultaneously measuring a reflected integration intensity of each of the 113 diffraction line and the 220 diffraction line by an energy dispersive type detector). FIG. 4 schematically shows the relationship between the reflection intensity of the standard sample which exhibits a random orientation and is scored as 1.0, and the sheet surface position of the X-ray intensity level in accordance with each orientation.

Figure 5:
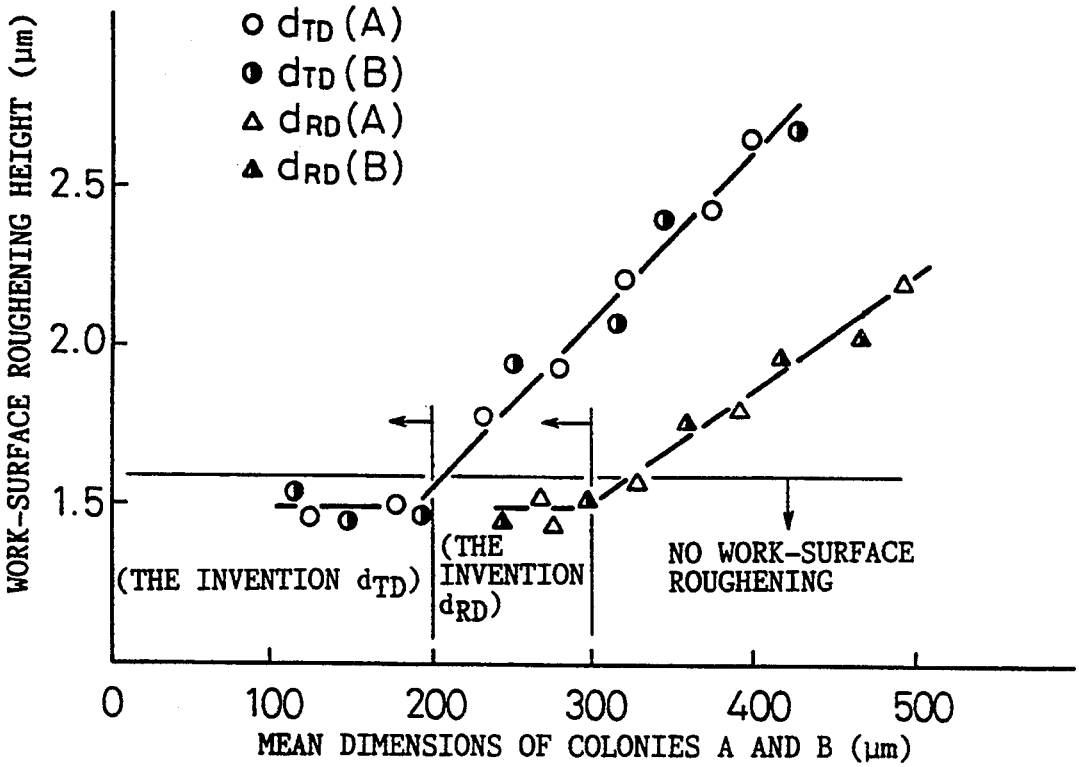
FIG. 5 is a diagram showing the relationship between mean dimensions of colonies A and B and machining surface roughness height.
Figure 6:
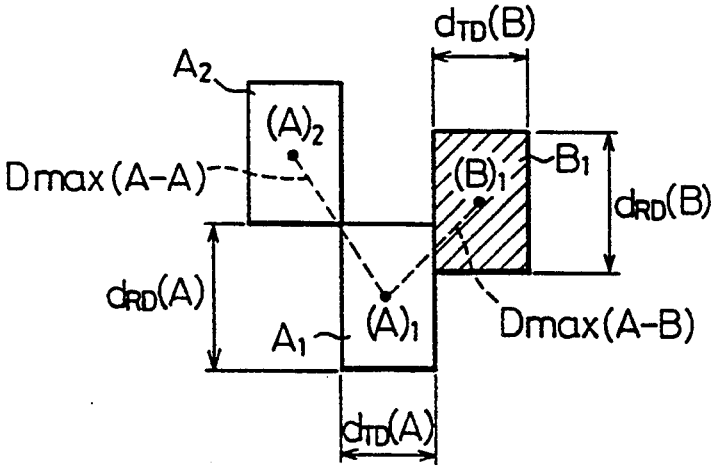
FIG. 6 is a diagram schematically showing a positional relationship between the colonies A and B.

At this time, the 220 reflection intensity and the 113 reflection intensity alternately change. If the 220 reflection intensity is predominant, the colony is assumed as the (B) orientation colony and if the 113 reflection intensity is predominant, it is assumed as the (A) orientation colony. The position at which the 220 reflection intensity and the 113 reflection intensity cross each other is defined as the boundary position between the (A) and (B) orientation colonies. Assuming that the mean dimensions of the colonies A and B in the rolling direction measured on the basis of this definition are $d_{RD}$(A) and $d_{RD}$(B), respectively, and their mean dimensions in the direction of the sheet width are $d_{TD}$(A) and $d_{TD}$(B), respectively, the relationship between these values and the work-surface roughening height is shown in FIG. 5. In other words, when both of $d_{RD}$(A) and $d_{RD}$(B) are below 300 μm and both of $d_{TD}$(A) and $d_{TD}$(B) are below 200 μm, the work-surface roughening height is below the allowable limit (1.6 μm).

It has been found out that when the colonies A and B exist mutually uniformly with the dimensions below a certain critical value as described above, work-surface roughening does not occur. Here, the term "exist mutually uniformly" means the following condition.

Namely, the term represents the condition where the colonies A and B exist in mixture in the steel sheet in such a fashion that a maximum value $D_{max}$(A-A) of a line connecting the area centroids of arbitrary colonies such as the area centroid $(A)_1$ of the colony $A_1$ and the area centroid $(A)_2$ of the same kind of the colony $A_2$ which is most adjacent to the colony $A_1$ is not greater than 350 μm, and the maximum value $D_{max}$(A-B) of a line connecting the area centroid $(A)_1$ of the colony $A_1$ and the area centroid $(B)_1$ of a different kind of the colony $B_1$ which is most adjacent to the colony $A_1$ is not greater than 350 μm.

The result described above exhibits substantially the same tendency at an arbitrary sheet thickness layer portion parallel to the sheet surface of the steel sheet.

Hereinafter, the effects of the components of the steel according to the present invention will be explained.

The steel according to the present invention is an austenitic stainless steel containing not greater than 0.09 mass % of C+N and having $Md_{30}$ defined by $Md_{30}=413-462(C+N)-9.2Si-8.1Mn-13.7Cr-18.5Mo-9.5(Ni+Cu)$ (where each component is expressed in terms of mass %) in the range of 30° to 60° C.

To suppress age cracking of a sheet product of the steel of the present invention with press working, the amount of C+N is set to be not greater than 0.09 mass %.

As to other component elements, component adjustment is carried out so that generally, Si is not greater than 1 mass %, Mn is not greater than 2 mass %, P is not greater than 0.04 mass %, S is not greater than 0.03 mass %, Ni is from 8.00 to 10.5 mass %, Cr is from 18.00 to 20.00 mass %, Mo is not greater than 0.3 mass % and Cu is not greater than 0.3 mass %.

By the way, the relationship between the $Md_{30}$ value and the mean gamma particle size and the work-surface roughening height is already shown in FIG. 1, and the reason why such a relationship is observed will be examined as follows from the aspect of the texture.

The texture of the rapidly quenched strip in the present invention is {100}<uv0>. In other words, the normal of the sheet surface and the <001> axis are parallel to each other, and the crystal grains of the gamma phase rotate around this axis in various directions. When a quenched strip of a low $Md_{30}$ material having a $Md_{30}$ point of less 30° C. is cold rolled, particularly when the mean gamma grain diameter of the strip is greater than about 100 μm, non-uniform deformation during cold rolling is promoted. Since the production quantity of the deformation induced martensite is relatively small, too, it also occurs at structurally non-uniform places. The martensite phase produced at this time exhibits a BCC crystal structure. Therefore, this phase exhibits the rolled texture of so-called alpha-iron due to rolling, and {113}<001>α or {332}<113>α become the primary orientations. On the other hand, the primary orientation of the rolled texture of the gamma base phase becomes {110}<112>. When annealing is carried out after cold rolling, the martensite reversively transforms to the gamma phase. In this instance, by a relationship of K-S orientation, the rolling orientation of the alpha-iron transforms to the gamma phase orientations {110}<001>, {110}<112>, {110}<111>. Also, {112}<111> and {113}<332> as the grain-growth orientation at high temperature occur from the vicinity of the {110}<112> band structure as the rolling orientation of the gamma phase. When the mean gamma grain diameter of the slab is large, non-uniformity of deformation during cold rolling is reflected on localization of the cold rolling orientation and it affects as such the annealing texture. As a result, the {112} orientation colony and the {110} orientation colony are believed to be formed.

In contrast, when the structure is a fine-grained structure where the mean gamma grain size is smaller than about 100 μ m even in the same low $Md_{30}$ material, deformation during cold rolling becomes uniform. In such a case where uniform deformation is predominant, when the forming behaviour of the martensite and the forming behaviour of the gamma phase texture at a cold rolling and the initial stage of annealing are substantially the same as those in the case of the coarse gamma grains, the frequency of the existence of the {110} grains which are produced due to the reverse transformation of the martensite to gamma in the vicinity of the {112} grains becomes higher provided and the {112} grains are more likely to grow by invading the {110} grains. As a result, the growth of the {110} orientation colony is restricted and a uniform structure wherein the {112} orientation relatively develops is formed. Accordingly, work-surface roughening in this case is small.

However, it is extremely difficult to keep the mean grain diameter of the low $Md_{30}$ material at below 100 μm because cooling control at the time of production of the strip is very difficult.

When the rapid cooled slab having a structure of which the $Md_{30}$ is higher than about 30° C. is cold rolled, the production quantity of the martensite during cold rolling becomes greater than the low $Md_{30}$ material, and the martensite phase is likely to occur uniformly in the cold rolled structure. As a result, a relatively large quantity of the {110} orientations develop in the texture after annealing, but the progress of the colony in which {112} and {110} orientations exist in segregation is restricted. Particularly when the mean gamma grain diameter is reliably lower than 100 μm, the effect described above functions effectively and work-surface roughening becomes extremely small.

When $Md_{30}$ is raised to about 60° C., this effect becomes more greater. Even though control of the cooling condition is not effected satisfactorily and the mean gamma grain diameter of the slab becomes more than about 150 μm, the induced martensite grains are likely to precipitate during cold rolling, and work-surface roughening can be made extremely small by breaking the coarse grains so as to make the gamma grain diameter small. However, when $Md_{30}$ is excessively increased to above 60° C., cold workability of the sheet drops. Therefore, $Md_{30}$ must be limited to not higher than 60° C.

As described above in detail, in order to prevent work-surface roughening of the product in the present invention, it is necessary to regulate the $Md_{30}$ point based on the composition to the range of 30° to 60° C. and to limit the mean gamma grain diameter of the rapidly cooled strip to not greater than 150 μm and preferably, not greater than 100 μm. The present inventors have made intensive studies on the solidification cooling rate of the strip, and the relationship between the cooling rate to 1,200° C. after solidification and the mean gamma grain diameter of the strip. As a result, the inventors have found out that the mean gamma grain diameter of the resulting strip becomes below 100 μm when the solidification cooling rate of the austenitic stainless steel strip comprising the composition already described and having a thickness of below 10 mm is set to 100° C./set and the strip is cooled at a cooling rate of at least 50° C./sec from the highest possible temperature to 1,200° C. after solidification.

The strip produced in this way is cooled, is then twice subjected to cold rolling and is finally annealed. Temper rolling is carried out in a customary manner, whenever necessary, after final annealing.

Cold rolling is carried out by so-called "twice rolling" from the thickness of the cast strip to a thickness approximate to that of the final product. In other words, cold rolling is first carried out at a reduction of at least 10% and preferably at least 30%, and after intermediate annealing is effected at a temperature of 1,000° to 1,200° C., cold rolling is then carried out to the final thickness. The reason why cold working of at least 10% is made is because, if the reduction is less than 10%, the strain introduced into the gamma phase due to working is small and the production quantity of the $\alpha'$ phase (strain induced martensite transformation phase) is also small so that the recrystallization structure after intermediate annealing becomes coarse, and the colonies which result in work-surface roughening remain in the final product. The intermediate annealing temperature must be selected from the range of 1,000° C., at which uniformity of the orientation distribution starts occurring due to the grain growth to 1,200° C. as the lower limit temperature at which the growth of the grains becomes remarkable and the colonies remain in the product.

The mechanism of preventing work-surface roughening of the product on the basis of the method of the present invention is assumed to be as follows.

FIGS. 7(A) to 7(E) show the process from the as-casted state (slab) to the final annealing and the textures at these points. Hereinafter, the explanation will be given on each process step.

Figure 7A:
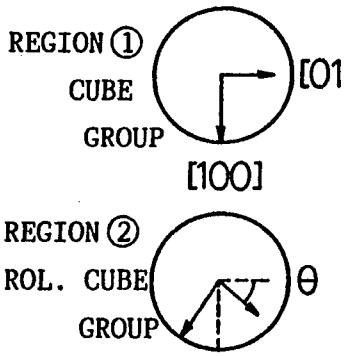
FIGS. 7(A) to 7(E) are schematic views of sectional structures parallel to rolling plane showing the transition of the microstructures when cold rolling and annealing are carried out from a cast state for two kinds of orientation regions ① and ②.

(1) Cast structure (FIG. 7(A))

In the austenitic stainless steel thin strip produced by continuous casting of twin drums type, the texture of the cast strip comprises ① Cube orientation: {100}<011> and ② Rotated Cube: {100}<uv0> both of which form colonies with the coarse columnar crystal gamma grains in the unit (that is ① regions and ② regions locally exist).

When $Md_{30}$ of the molten steel component is controlled to the range of 30° to 60° C. , in the Cube group in each of the regions described above, the ferrite mode solidification preferentially occurs, so that the diameter of the cast structure Cube is reduced (the solidified grain diameter becomes small), and the production quantity of the Rotated Cube group (the term hereby represents the orientation grains other than the positive Cube group) becomes great.

Figure 7B:
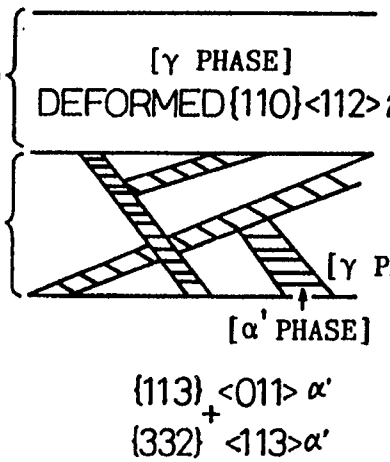

(2) After cold rolling (FIG. 7(B))

When this solidified structure is cold rolled, the primary orientation of the rolled texture of the gamma phase in the ① region becomes {110}<112>$\gamma$ and the strain induced martensite transformation ($\gamma \rightarrow \alpha'$) is likely to occur in the ② region and the working strain is likely to be accumulated, too. As a result, {113}<01-1>α'+{332}<113>α' becomes the primary orientation in the ② region.

Figure 7C:
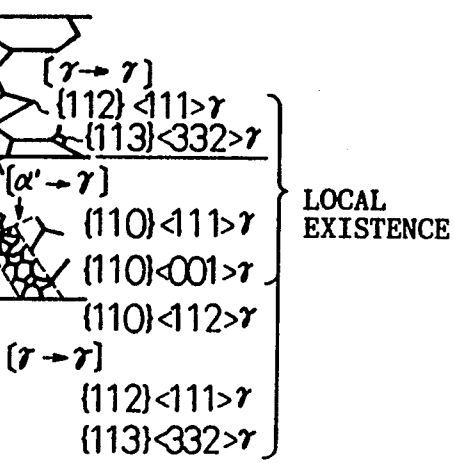

(3) After intermediate annealing (FIG. 7(C))

When the cold rolled structure described above is annealed, {112}<111>γ and {113}<332>γ occur due to the recrystallization and the grain growth of the gamma phase in the ① region, and {110}<111>γ.{11-0}<001>γ.{110}<112>γ occur due to the α'→γ reverse transformation, besides the recrystallization and the grain growth orientations of the gamma phase in the ② region.

Since the regions having the different orientations locally exist in great units as described above, non-uniform plastic behaviour of the product is promoted, so that work-surface roughening is produced.

When the molten steel component having $Md_{30}$ of at least 30° C. is selected, the cast structure comes to possess smaller grains as described above and the Rotated Cube orientation increases. At the same time, the production quantity of the α' phase increases after cold rolling and the fine grain orientation is formed due to the α'→γ reverse transformation after annealing. Accordingly, the metal structure becomes all the more fine-grained and the crystal grain groups having the crystal orientations of the recrystallized structure of intermediate annealing, such as {112}<111>γ and {110}<111>γ0 orientations, are produced in a uniform mixture, so that the formation of the colonies is reduced. Accordingly, work-surface roughening can be reduced.

Figure 7D:
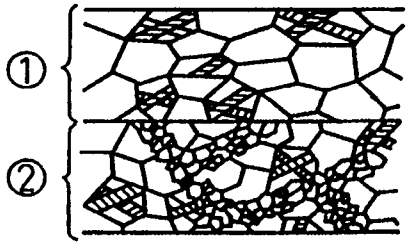

(4) After second cold rolling (FIG. 7(D))

In the present invention, cold rolling is dividedly carried out twice. In other words, cold rolling of the item (2) is the first cold rolling, and after annealing of the item (3) is made, the second cold rolling is carried out. Since the structure becomes finer due to recrystallization described above at this time, even though the martensite transformation occurs due to the same mechanism as during the first cold rolling operation, the martensite region itself becomes smaller, and the γ phase and the α' phase are finely mixed as a whole. In the case of the components having a high $Md_{30}$ value, the tendency towards the finer grains is further promoted. In consequence, the formation of the colonies is further reduced.

Figure 7E:
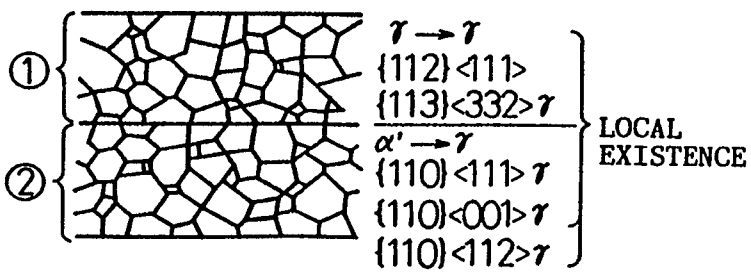

(5) After final annealing (FIG. 7(E))

When this structure is annealed, the recrystallization and the grain growth of the gamma phase finely dispersed by the same mechanism as that during annealing of the item (3) and the inverse transformation of the α' phase finely dispersed, i.e. (α'→γ), occurs, so that the regions of respective orientations are finely mixed.

When the regions having mutually different orientations exists in mixture in the fine unit, plastic anisotropy of the product can be mitigated and the occurrence of work-surface roughening can be prevented.

EXAMPLE

Example 1

By using the twin drums type's continuous casting machine, thin strip-like slabs having a thickness of 2.5 m were casted from austenitic system stainless steels (SUS304 steel) having $Md_{30}$ values changed at five levels on the basis of the composition tabulated in Table 2, at a solidification cooling rate of about 300° C./sec. After solidification, the slabs having various gamma grain diameters were obtained by cooling the slabs at a cooling rates of 20° to 500° C./sec from 1,400° C. to 1,200° C. The slabs were then pickled, and sheet products were obtained by twice cold rolling these slabs. In other words, each slab after pickling was first cold rolled at a reduction of 40% and was further intermediate annealed (at 1,150° C. and retained at this temperature for 20 seconds). Next, cold rolling was carried out till the slab became a thickness of 0.6 mm, and final annealing and temper rolling were carried out to obtain a sheet product. As a Comparative Example, sheet products were produced by single cold rolling step. In this case, the slab after pickling was cold rolled at a reduction of 76% and was finally annealed, and as a result, sheet product having a thickness of 0.6 mm was formed. Thereafter, the colony dimension of the sheet plane at a ¼ sheet thickness layer portion of each of these products was measured by a crystal orientation topograph analyzer. Each product was also subjected to cylinder flat bottom bulge working (punch diameter 50 mm and a bulging height of 10 mm) so as to measure the work-surface roughening height at the flat bottom portion. Workability of the bulge worked material and age cracking were also examined.

TABLE 2

| Sample | | Chemical composition (mass %) | | | | | | | | | | | | | $Md_{30}$ |
|---|---|---|---|---|---|---|---|---|---|---|---|---|---|---|---|
| | | C | Si | Mn | P | S | Cu | Ni | Cr | Mo | Al | N | O | C + N | (°C.) |
| The | 6 | 0.025 | 0.50 | 1.02 | 0.020 | 0.002 | 0.2 | 8.75 | 18.40 | 0.23 | 0.002 | 0.027 | 0.012 | 0.052 | 34.3 |
| Invention | 7 | 0.030 | 0.60 | 0.98 | 0.023 | 0.002 | 0.1 | 8.52 | 18.10 | 0.25 | 0.002 | 0.012 | 0.012 | 0.042 | 45.5 |
| Comparati- | 8 | 0.041 | 0.71 | 0.95 | 0.015 | 0.003 | 0.3 | 8.94 | 18.52 | 0.13 | 0.003 | 0.024 | 0.013 | 0.065 | 23.3 |
| ve | 9 | 0.005 | 0.65 | 0.90 | 0.018 | 0.002 | 0.2 | 8.65 | 18.10 | 0.18 | 0.002 | 0.005 | 0.011 | 0.010 | 62.1 |
| Examples | 10 | 0.070 | 0.70 | 0.97 | 0.022 | 0.003 | 0.2 | 8.52 | 18.00 | 0.20 | 0.003 | 0.030 | 0.011 | 0.100 | 19.3 |

Table 3 illustrates the evaluation results of these characteristics. In the steels of the present invention (Samples 6 and 7) having $Md_{30}$ of at least 30° C., the colony dimensions $d_{TD}(A)$ and $d_{TD}(B)$ were not greater than 200 μm and $d_{RD}(A)$ and $d_{RD}(B)$ were not greater than 300 μm. The maximum line distance connecting the area centroid of an arbitrary colony to the area centroid of the same kind of the colony closest to the former was not greater than 350 μm and the maximum line distance connecting the former to the area centroid of a different kind of colony closest to the former was not greater than 350 μm. It was thus confirmed that the colony A and the colony B having the dimensions below the critical value existed in a uniform mixture in the steels. As a result, work-surface roughening height was below the allowable limit in all of the steels of the present invention and they exhibited good surface properties. On the other hand, in the steel of Comparative Example (Sample 8), work-surface roughening was inferior because the colony dimension exceeded the critical value. Comparative Example (Sample 8) having $Md_{30}$ of above 60° C. had good work-surface roughening but its workability was inferior. Age cracking resistance was excellent throughout all the samples.

TABLE 3

| | Sample | $Md_{30}$ (°C.) | Strip γ grain diameter (μm) | Steps* (1CR/2CR) | Product sheet thickness (mm) | Colony dimension (μm) $d_{TD}(A)$ | $d_{TD}(B)$ | $d_{RD}(A)$ | $d_{RD}(B)$ |
|---|---|---|---|---|---|---|---|---|---|
| Example of the invention | 6 | 34.3 | 95 | 2CR | 0.6 | 96 | 98 | 120 | 123 |
| | 6 | 34.3 | 120 | " | " | 125 | 118 | 160 | 157 |
| | 7 | 45.5 | 115 | " | " | 120 | 134 | 152 | 142 |
| | 7 | 45.5 | 150 | " | " | 168 | 163 | 206 | 202 |
| Comparative example | 6 | 34.3 | 120 | 1CR | 0.6 | 280 | 285 | 442 | 447 |
| | 7 | 45.5 | 115 | " | " | 240 | 250 | 380 | 390 |
| | 8 | 23.3 | 140 | 2CR | " | 197 | 205 | 305 | 309 |
| | 8 | 23.3 | 203 | " | " | 322 | 317 | 493 | 485 |
| | 9 | 62.1 | 130 | " | " | 120 | 126 | 150 | 155 |
| | 10 | 19.3 | 140 | " | " | 205 | 202 | 297 | 303 |

| | Sample | Colony dimension (μm) $D_{max}(A-A)$ | $D_{max}(B-B)$ | $D_{max}(A-B)$ | Work-surface roughening height (μm) | Age Cracking | Workability |
|---|---|---|---|---|---|---|---|
| Example of the invention | 6 | 160 | 162 | 159 | good (1.4) | good | good |
| | 6 | 205 | 201 | 204 | good (1.4) | " | " |
| | 7 | 197 | 199 | 198 | good (1.4) | " | " |
| | 7 | 269 | 255 | 263 | good (1.5) | " | " |
| Comparative example | 6 | 526 | 536 | 530 | inferior (1.9) | good | good |
| | 7 | 453 | 467 | 460 | inferior (1.8) | " | " |
| | 8 | 370 | 375 | 373 | inferior (1.7) | " | " |
| | 8 | 589 | 585 | 584 | inferior (2.1) | " | " |
| | 9 | 196 | 200 | 201 | good (1.5) | " | inferior |
| | 10 | 363 | 366 | 369 | inferior (1.7) | " | inferior |

(Note)
(1) Steps*

2CR: strip 2.5 mm-thick $\xrightarrow{\text{40\% cold rolling}}$ 1.5 mm-thick (intermediate annealing)

$\xrightarrow{\text{60\% cold rolling}}$ 0.6 mm-thick (final annealing)

1CR: strip 2.5 mm-thick $\xrightarrow{\text{70\% cold rolling}}$ 0.6 mm-thick $\longrightarrow$ (final annealing)

(2) $D_{max}(A-A)$, $D_{max}(B-B)$ } maximum value of linear distance connecting area centroids of most adjacent colonies of the same kind $D_{max}(A-B)$ . . . maximum value of linear distance connecting area centroids of most adjacent colonies of different kinds

Example 2

The relationship between the first cold rolling (the cold rolling ratio imparted before intermediate annealing) and the work-surface roughening characteristics in the twice rolling method was examined as to the steel of the present invention (sample 7, mean gamma grain diameter of slab: 150 μm) produced under the casting condition shown in Example 1 and tabulated in Table 2. In other words, after pickling, the slab was cold rolled at a rolling ratio of 5 to 68%, was then intermediate annealed (at 1,150° C. and retained at this temperature for 20 seconds) and was thereafter cold rolled to a thickness of 0.6 mm. Thereafter, final annealing and temper rolling were carried out, and work-surface roughening and other characteristics were examined in the same way as in Example 1. The evaluation results are tabulated in Table 4. When the first cold rolling ratio was higher than 10%, a particular improvement of work-surface roughening could be observed and when the first cold rolling ratio was higher than 30%, this improvement effect became more remarkable.

TABLE 4

| | Sample | $Md_{30}$ (°C.) | Strip γ grain diameter (μm) | Step | 1st rolling ratio (%) | Product sheet thickness (mm) | Colony dimension (μm) $d_{TD}(A)$ | $d_{TD}(B)$ | $d_{RD}(A)$ | $d_{RD}(B)$ |
|---|---|---|---|---|---|---|---|---|---|---|
| Examples of the Invention | 7 | 45.5 | 150 | 2CR | 10 | 0.6 | 212 | 230 | 254 | 258 |
| | " | " | " | " | 20 | " | 210 | 207 | 252 | 257 |
| | " | " | " | " | 30 | " | 175 | 170 | 226 | 225 |
| | " | " | " | " | 40 | " | 168 | 163 | 206 | 202 |
| | " | " | " | " | 50 | " | 134 | 130 | 190 | 192 |
| | " | " | " | " | 60 | " | 124 | 122 | 173 | 165 |
| | " | " | " | " | 68 | " | 105 | 107 | 160 | 170 |
| Comparative | 7 | 45.5 | 150 | 2CR | 5 | 0.6 | 280 | 270 | 350 | 355 |

TABLE 4-continued

| Example | Sample | Colony dimension (μm) $D_{max}$(A-A) | $D_{max}$(B-B) | $D_{max}$(A-B) | Work-surface roughening height (μm) | Age cracking | Workability |
|---|---|---|---|---|---|---|---|
| Examples of the invention | 7 | 330 | 340 | 333 | good (1.6) | good | good |
| | " | 328 | 320 | 325 | good (1.6) | " | " |
| | " | 285 | 275 | 272 | good (1.5) | " | " |
| | " | 265 | 270 | 275 | good (1.5) | " | " |
| | " | 232 | 240 | 238 | good (1.4) | " | " |
| | " | 214 | 220 | 210 | good (1.4) | " | " |
| | " | 193 | 197 | 199 | good (1.4) | " | " |
| Comparative Example | 7 | 448 | 430 | 420 | inferior (1.8) | " | " |

[Industrial Applicability]

As described above, it is possible in accordance with the present invention to stably produce an austenitic stainless steel sheet devoid of the occurrence of work-surface roughening but having excellent surface quality by a strip continuous casting production process.

We claim:

1. An austenitic stainless steel sheet having excellent surface quality characterized in that said steel sheet contains not greater than 0.090 mass % of C+N and has an $Md_{30}$ value of 30° to 60° C. defined by $Md_{30}=413-462(C+N)-9.2Si-8.1Mn-13.7Cr-18.5Mo-9.5(Ni+Cu)$ (whereby each of said components is expressed in terms of mass %), and moreover, colonies (A) having a mean dimension $d_{RD}(A)$ in a rolling direction and a mean dimension $d_{TD}(A)$ in a sheet width-wise direction and having primary crystal orientations of {112}<111> and {113}<332>, and colonies B having a mean dimension $d_{TD}(B)$ in the rolling direction and a mean dimension $d_{TD}(B)$ in the sheet width-wise direction and having primary crystal orientations of {110}<111>, {110}<112> and {110}<001>, exist in a uniform mixture in said steel sheet, and said $d_{RD}(A)$ or said $d_{RD}(B)$ is not greater than 300 μm and said $d_{TD}(A)$ or said $d_{TD}(B)$ is not greater than 200 μm.

2. An austenitic stainless steel sheet according to claim 1, wherein said colonies A and said colonies B are mixed in said steel sheet in such a fashion that the maximum value of a linear distance connecting an area centroid of an arbitrary colony to an area centroid of a colony of the same or different kind which is the closest to the former is not greater than 350 μm, respectively.

3. A method of producing an austenitic stainless steel sheet having excellent surface quality, comprising:

casting a molten steel having a composition containing not greater than 0.09 mass % of C+N and having an $Md_{30}$ value of 30° to 60° C. defined by $Md_{30}=413-462(C+N)-9.2Si-8.1Mn-13.7Cr-18.5Mo-9.5(Ni+Cu)$ (wherein each of said components is expressed in terms of mass %), to a thin strip-like slab having a thickness of not greater than 10 mm at a solidification cooling rate of at least 100° C./sec by a continuous casting machine having a mold wall moving in synchronism with said slab;

cooling the resulting slab at a cooling rate of at least 50° C./sec from the highest possible temperature to 1,200° C. after solidification;

applying cold rolling of at least 10%;

effecting intermediate annealing at a temperature of 1,000° to 1,200° C.; and effecting cold rolling to a final thickness and then effecting final annealing.

4. A production method according to claim 3, wherein said first cold rolling is carried out at a reduction of 10 to 30%.

5. A production method according to claim 3, wherein said first cold rolling is carried out at a reduction of more than 30%.

* * * * *

UNITED STATES PATENT AND TRADEMARK OFFICE

CERTIFICATE OF CORRECTION

PATENT NO. : 5,376,195

DATED : December 27, 1994

INVENTOR(S) : Takuji SHINDO, et al.

It is certified that error appears in the above-indentified patent and that said Letters Patent is hereby corrected as shown below:

Column 2, line 62, change "other works" to --other words--.

Column 3, line 10, change "contentional" to --conventional--.

Column 3, line 58, change "strip like" to --strip-like--

Column 3, line 60, change "the" to --a--.

Column 3, line 61, delete "of".

Column 4, line 8, between "where" and "is" insert --it-- and delete "a" before "roping-control".

Column 4, line 37, change "slightly" to --slight--.

Column 8, line 55, after "less" insert --than--.

Column 9, line 27, delete "higher provided" and insert --greater--.

Column 9, line 52, delete "more".

UNITED STATES PATENT AND TRADEMARK OFFICE

CERTIFICATE OF CORRECTION

PATENT NO. : 5,376,195 Page 2 of 2

DATED : December 27, 1994

INVENTOR(S) : Takuji SHINDO, et al.

It is certified that error appears in the above-indentified patent and that said Letters Patent is hereby corrected as shown below:

Column 11, line 28, delete "0" before "orientations,".

Column 11, line 66, change "exists" to --exist--.

Column 12, line 1, change "EXAMPLE" to --EXAMPLES--.

Column 12, line 12, change "rates" to --rate--.

Column 15, line 37, change "$d_{TD}(B)$" to --$d_{RD}(B)$--.

Signed and Sealed this

Twenty-seventh Day of June, 1995

*Attest:*

Bruce Lehman

BRUCE LEHMAN

*Attesting Officer*

*Commissioner of Patents and Trademarks*